United States Patent [19]

Manthey et al.

[11] 4,082,100

[45] Apr. 4, 1978

[54] APPARATUS FOR COOLING HOT SLABS

[75] Inventors: Willi Bruno Manthey, Duisburg; Horst Deiwick, Krefeld-Gartenstadt, both of Germany

[73] Assignee: BWG Bergwerk- und Walzwerk-Maschinenbau GmbH, Duisburg, Germany

[21] Appl. No.: 786,396

[22] Filed: Apr. 11, 1977

[30] Foreign Application Priority Data

Apr. 10, 1976 Germany ..... 2615924

[51] Int. Cl.[2] ..... B08B 3/04

[52] U.S. Cl. ..... 134/76; 198/412; 214/1 QG; 214/87

[58] Field of Search ..... 214/1 Q, 1 QA, 1 QB, 214/16 B, 17 R, 87, 89, 91 R, 92; 198/412, 413; 134/76, 133; 266/132

[56] References Cited

U.S. PATENT DOCUMENTS

| | | | |
|---|---|---|---|
| 3,680,344 | 8/1972 | Manthey et al. | 134/76 X |
| 3,895,498 | 7/1975 | Manthey et al. | 134/76 X |

*Primary Examiner*—Robert G. Sheridan
*Attorney, Agent, or Firm*—Karl F. Ross

[57] ABSTRACT

Hot slabs to be carried to a soaking pit by a railborne transporter, provided with two sets of vertical guide bars flanking an array of vertically reciprocable gripper arms, ride prone on a first roller conveyor to a pickup area where they are erected by a first group of swingable prongs for engagement by the gripper arms as the transporter moves over that area. Cooled slabs coming from the soaking pit are delivered by these gripper arms to a receiving area alongside the pickup area where they are transferred to a second group of swingable prongs subsequently depositing them prone on a second roller conveyor for removal to another destination.

10 Claims, 6 Drawing Figures

APPARATUS FOR COOLING HOT SLABS

FIELD OF THE INVENTION

Our present invention relates to an apparatus for cooling hot metal slabs, referred to hereinafter as slabs, by immersing them in a suitable fluid, generally water, within a soaking pit forming a multiciplicity of slab-receiving compartments or bays.

BACKGROUND OF THE INVENTION

In our copending application Ser. No. 702,587 filed July 6, 1976, now U.S. Pat. No. 4,036,243, we have disclosed an apparatus of this type wherein a railborne transporter includes a traverse or bridge spanning the pit. Supported on the transporter are two carrying cages alignable with a pair of adjoining compartments, these cages being defined by two sets of guide bars depending from the traverse at locations separated in the transport direction and by an array of gripper arms disposed therebetween; the gripper arms are connected with a hoisting mechanism by which they can be lowered into the pit to deposit a hot slab from one cage in a selected compartment and to lift a cooled slab from an adjoining compartment into the other cage. For this purpose each gripper arm is provided at its lower end with retractable slab-supporting means which can be alternately extended across the bottoms of the two cages or moved into a neutral position. The slab-supporting means may be feet rigid with their gripper arms which in that instance are rotatable through 180° about a vertical axis; alternatively, the feet may be designed as horizontally or vertically swingable latch members as likewise disclosed in our above-identified copending application and in our prior U.S. Pat. No. 3,895,498.

In British patent Specification No. 1,108,929 there is described an annular soaking pit together with a radially disposed roller conveyor serving for the delivery of hot slabs to the pit and for the removal of cooled slabs therefrom. A positioning mechanism at the end of the roller conveyor erects the oncoming prone slabs which are then engaged by a gripper and lowered into a free soaking compartment; the gripper thereupon extracts a cooled billet from another soaking compartment after a certain rotation of the conveyor system and lays it onto the roller conveyor for transportation to a further destination.

OBJECT OF THE INVENTION

The object of our present invention is to provide a simplified system for the more efficient delivery of hot slabs to and removal of cooled billets from a soaking pit equipped with a transporter of the type described in our above-identified prior patent and copending application.

SUMMARY OF THE INVENTION

In accordance with our present invention we provide first and second positioning means disposed in a loading zone between a pickup area and a receiving area adjoining the soaking pit, the path of the transporter extending to a stop above that loading zone. Hot slabs are delivered to the pickup area by first conveyor means, preferably a set of driven rollers, on which they lie prone until they are erected by the first positioning means shortly before or during a stationing of the transporter at its aforementioned stop above the loading zone, one or more erected hot slabs being then in line with a first carrying cage of that transporter. One or more cooled slabs, brought to the loading zone in a second carrying cage of the transporter, are aligned at that point with the second positioning means so as to be engaged by the latter upon being lowered by the gripper means of the transporter in order to be deposited prone on second conveyor means, preferably also a set of driven rollers, for removal from the receiving area; the gripper means, having unloaded the cooled slabs from the second cage, can then seize the erected hot slab or slabs for transportation in the first cage to an available compartment of the soaking pit.

According to a more specific feature of our invention, each of the two positioning means comprises a swingable member which is reversibly rotatable through about 90° or 180°, around a horizontal axis perpendicular to the path of the transporter, by associated drive means individual to the two positioning means or common to both of them. Each of these swingable members advantageously includes a plurality of parallel prongs which may be substantially in line with respective rows of stakes forming the soaking compartments, these rows being parallel to the path of the transporter; thus, the prongs and the stakes are both laterally offset from the vertical guide bars defining the carrying cages of the transporter in accordance with the teaching of our copending application Ser. No. 702,587.

BRIEF DESCRIPTION OF THE DRAWING

The above and other features of our invention will now be described in detail with reference to the accompanying drawing in which.

SPECIFIC DESCRIPTION

Figure 1:
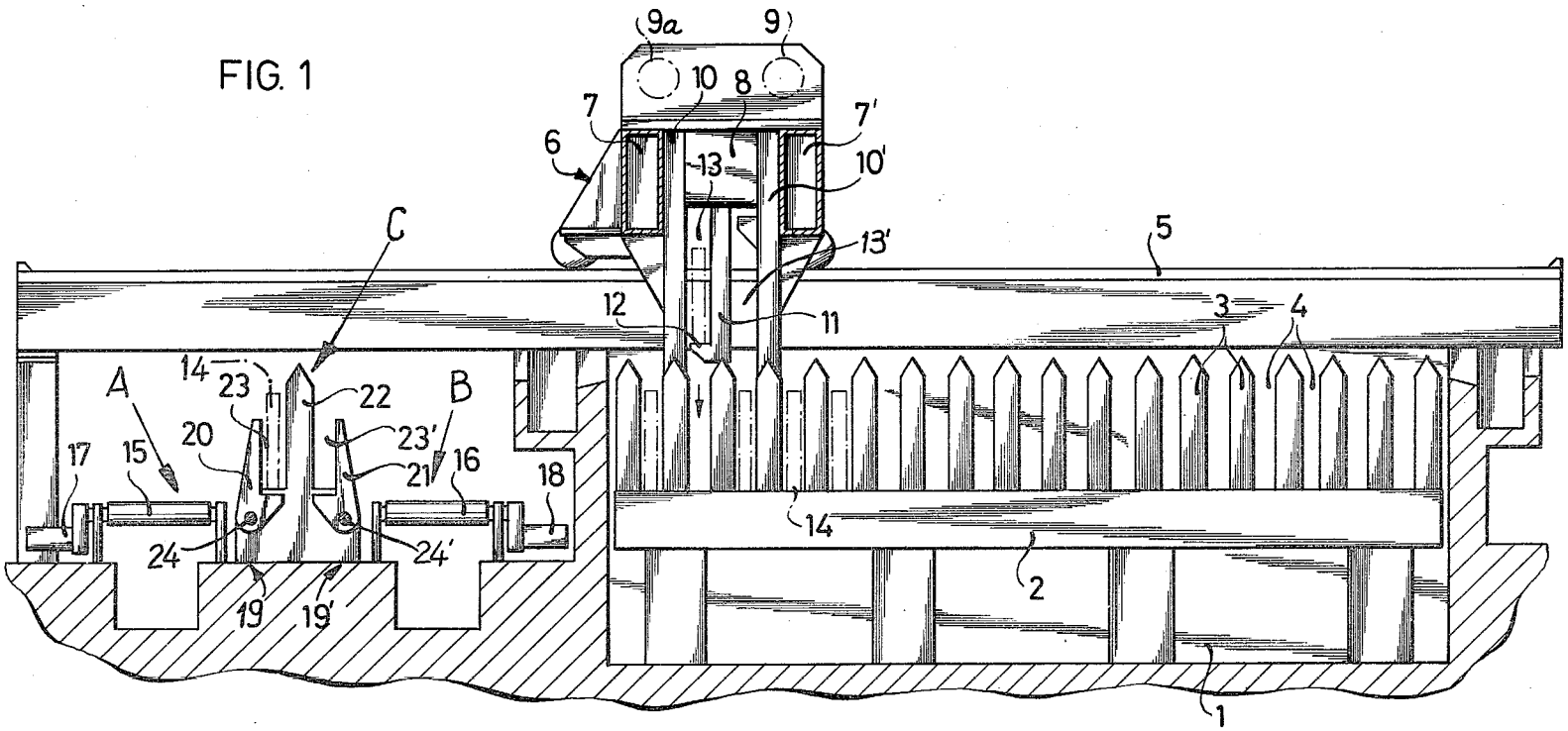
FIG. 1 is a longitudinal sectional view of an apparatus embodying our invention, including a loading zone between two roller conveyors adjoining a soaking pit and a transporter movable between the pit and the loading zone.
Figure 2:
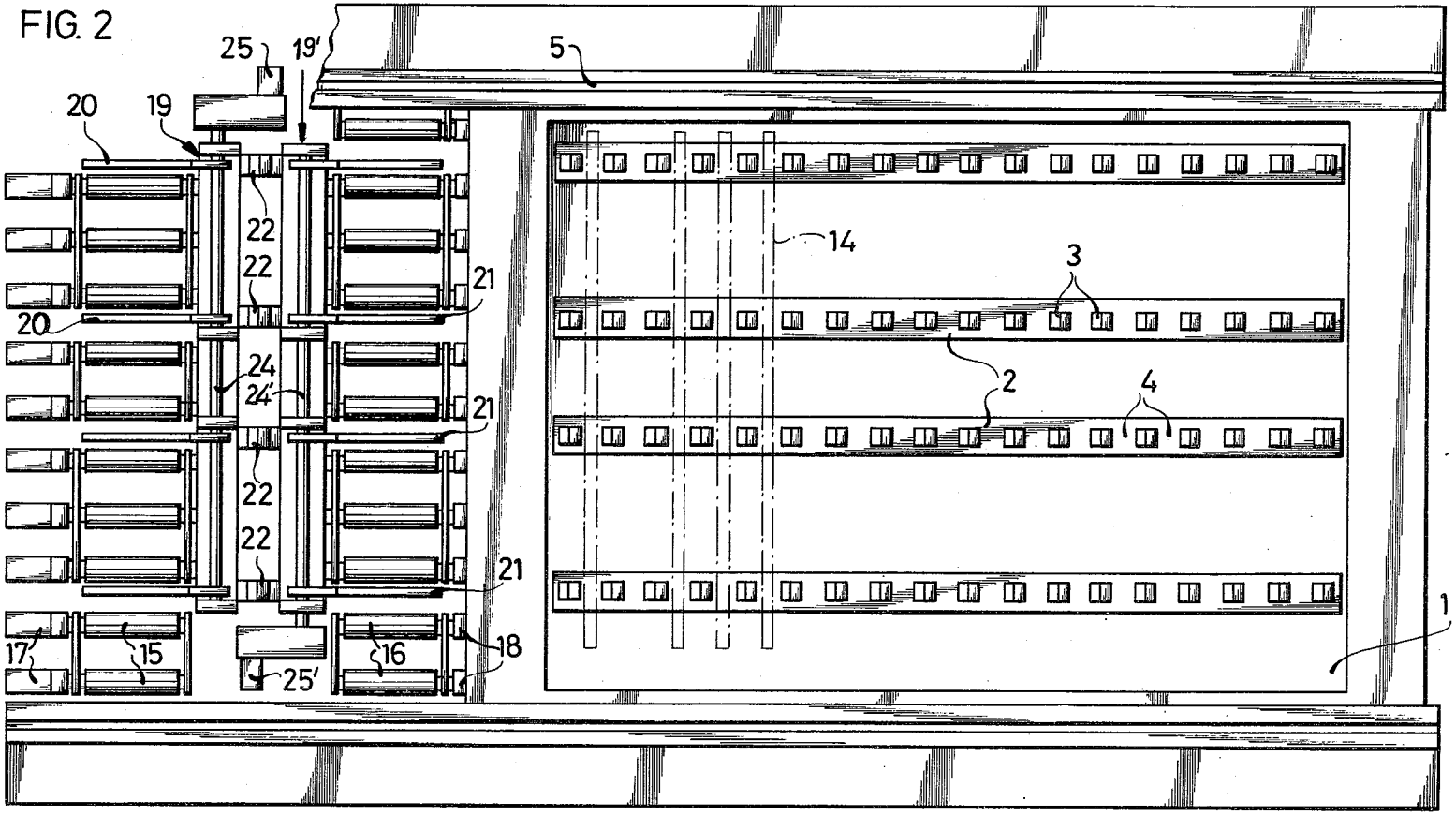
FIG. 2 is a top plan view of the apparatus shown in FIG. 1, with the transporter omitted.

In FIGS. 1 and 2 we have shown a soaking pit 1 of rectangular outline with a submerged supporting structure including four parallel beams 2; the beams carry respective rows of rising back teeth or stakes 3 to define a multiplicity of bays or compartments 4. Each of these compartments is designed to receive a single slab 14 resting ,n all four beams 2 (or a pair of slabs of about half that length supported by respective beam pairs) which are submerged within the pit in a nonillustrated body of water. The pit is flanked by two rails 5 extending along the major sides of its rectangular outline and supporting a transporter 6; the latter comprises two parallel hollow girders 7 and 7', constituting a traverse or bridge, between which a plurality of gripper arms 11 with slab-supporting feet 12 depend from a carriage 8 that is vertical reciprocable by a hoisting mechanism symbolized by an electric motor 9. Another electric motor **9*a* serves to rotate the several gripper arms 11 simultaneously about respective vertical axes to extend their feet 12 across the bottom of a first carrying cage 13, bounded by a set of vertical guide bars 10**, or across the bottom of a second carrying cage 13', bounded by a set of vertical guide bars 10'. The guide bars 10 and 10', fixedly secured to girders 7 and 7', are laterally offset from the rows of stakes 3, as are the gripper arms 11.

Two roller conveyors 15 and 16, whose rollers are individually driven by synchronized electric motors 17 and 18, are respectively disposed in a pickup area A and a receiving area B separated by a loading zone C; obviously, a single motor with a suitable transmission could be used for the rollers of either conveyor. Within that loading zone C we provide a pair of slab positioners 19 and 19' comprising respective sets of prongs 20 and 21 on a pair of horizontal shafts 24 and 24', perpendicular to the rails 5, which are generally L-shaped and in their upright position of FIG. 1 define the outer boundaries of repositories 23 and 23' for hot and cold slabs. The two repositories are internally bounded by a set of stationary posts 22 common to both positioners. The prongs 20, 21 and the posts 22 are in line with respective beams 2 carrying the stakes 3.

In the operation of the systems of FIG. 1 and 2, hot slabs 14 lying prone on rollers 15 are delivered to pickup area A where they come to rest above the prongs 20 which at this stage are swung outwardly (i.e. counterclockwise as viewed in FIG. 1) from their upright position into a substantial horizontal position between rollers 15 as seen in FIG. 2. Thereafter, the shaft 24 is rotated by its motor 25 and returns the prongs 20 to their upright position whereby the engaged slab within repository 23 is erected as shown in FIG. 1. The transporter 6, if not already stationed above loading zone C, is then moved to that zone so as to align its cages 13 and 13' with repositories 23 and 23', respectively. Next, the gripper arms 11 (which are in a position opposite the one shown in FIG. 1, with their feet 12 at the bottom of cage 13') are lowered to unload a cooled slab previously extracted from one of the compartments 4 into the repository 23' for engagement by the prongs 21 which thereupon are swung outwardly, i.e. clockwise as viewed in FIG. 1, to come to lie between rollers 16 whereby the previously erected slab is deposited prone on these rollers. As the slab so deposited is removed by the rollers 16 from the receiving area B, the slab now standing erect in repository 23 is seized by the gripper arms 11 which have meanwhile been rotated into their alternate position and which are then raised to lift the engaged slab into the cage 13 for transportation to an empty compartment 4. The cycle can then be repeated.

Figure 3:
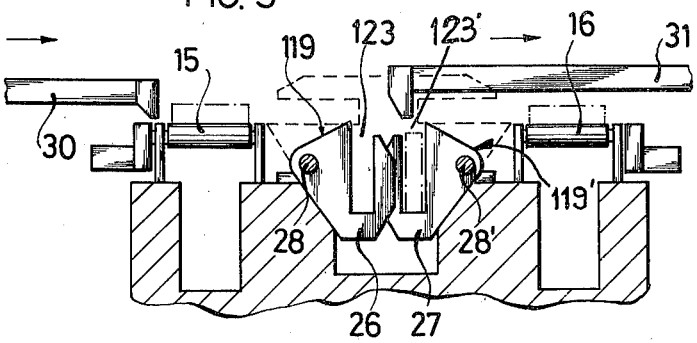
FIG. 3 is a longitudinal sectional view similar to the left-hand part of FIG. 1, illustrating a modification.
Figure 4:
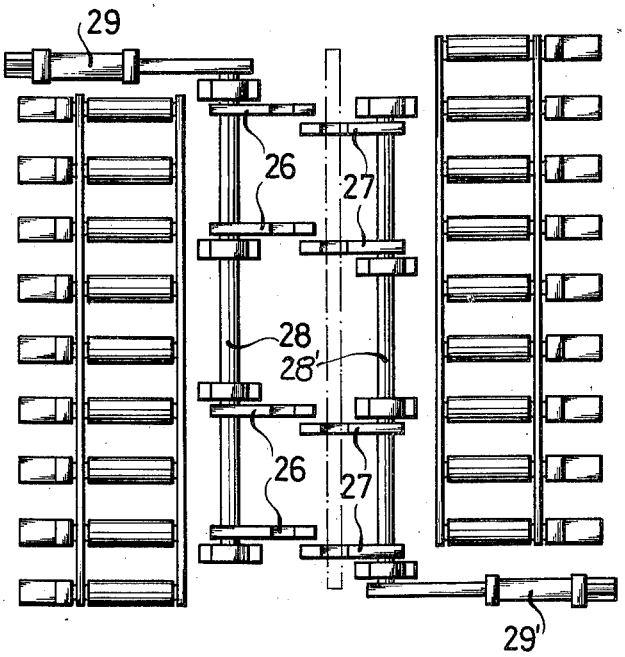
FIG. 4 is a top plan view of the assembly of FIG. 3.

In FIGS. 3 and 4 we have shown a pair of modified positioners 119 and 119' with generally J-shaped prongs 26 and 27 forming repositories 123 and 123'. The longer limbs of prongs 26 and 27 are mounted on respective shafts 28 and 28' driven by motors 29 and 29'. In this instance the fixed posts 22 are omitted and the J-shaped prongs 26 and 27 terminate short of the rollers 16 and 17 in their recumbent positions, indicated in dotted lines in FIG. 3; it is therefore necessary to provide reciprocable horizontal feeders 30 and 31 synchronized with the prong drives 29, 29' for respectively pushing an oncoming hot slab from rollers 15 into the recumbent prongs 26 and withdrawing a cooled slab from the recumbent prongs 27 for removal by rollers 16.

Figure 5:
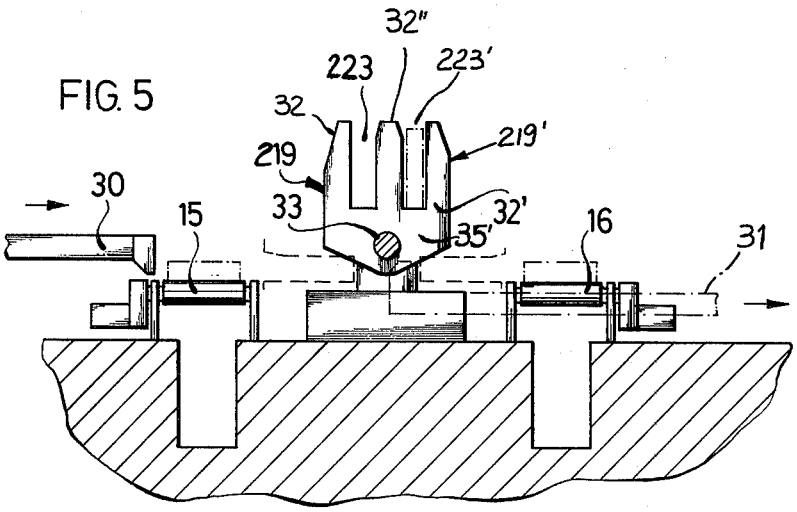
FIG. 5 and 6 are views similar to FIGS. 3 and 4, respectively, illustrating another modification.
Figure 6:
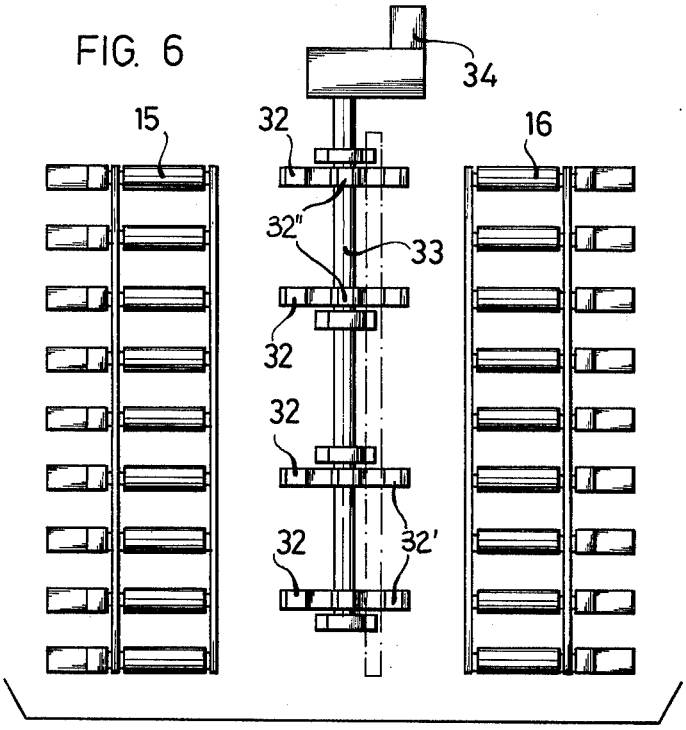

In FIGS. 5 and 6, finally, we have shown a simplified positioning mechanism particularly useful in the case of smaller slabs. The two positioners 219 and 219' are consolidated to form prongs 32, 32' on a common base 35 also carrying a third prong 32'' at its center, thereby defining with prongs 32 and 32' respective repositories 223 and 223'. The bases 35 are mounted on a common shaft 33 rotatable by a motor 34 through about 90° to either side from the upright position shown in FIGS. 5 and 6. A thruster 30 and an extractor 31 (the latter being illustrated only in phantom lines) are again used for loading and unloading hot and cold slabs, respectively.

The use of roller sets for bringing on hot slabs and carrying off cooled slabs is advantageous since it permits the prongs 20 and 21 to drop into spaces between the rollers. Particularly with the modified systems of FIGS. 3–6, however, these rollers may be replaced by other types of conveyors including, for example, endless bands, tow cables or sliding beams. The prongs of the positioning mechanism could be reciprocated by drive means other than electric motors, e.g. pneumatic or hydraulic jacks.

We claim:

1. In an apparatus for cooling hot slabs in a soaking pit divided into a plurality of slab-receiving compartments, wherein a railborne transporter includes a traverse spanning said pit, first and second guide means fixedly depending from said traverse at locations separated in the transport direction, vertically movable gripper means on said traverse disposed between said first and second guide means and defining therewith a first and a second carrying cage alignable with a pair of adjoining compartments, hoist means for raising and lowering said gripper means, and retractable slab-supporting means on said gripper means alternately extendable across the bottoms of said cages for depositing a hot slab from said first cage in a selected compartment and then lifting a cooled slab into said second cage from an adjoining compartment, the combination therewith of:

first and second positioning means disposed in a loading zone between a pickup area and a receiving area adjoining said pit, the path of said transporter extending to a stop above said loading zone;

first conveyor means for delivering hot slabs to said pickup area, said first positioning means being operable to engage a slab lying prone on said first conveyor means and to erect the engaged slab in line with said first cage upon a stationing of said transporter at said stop; and second conveyor means for removing cooled slabs from said receiving area, said second positioning means being alignable with said second cage upon a stationing of said transporter at said stop for engaging a slab lowered erect by said gripper means and depositing the engaged slab prone on said second conveyor means, said gripper means being thereupon operable to seize a slab erected by said first positioning means.

2. The combination defined in claim 1 wherein said first and second positioning means comprise each a swingable member and drive means for reversibly rotating said member through at least about 90° around a horizontal axis perpendicular to said path.

3. The combination defined in claim 2 wherein the swingable members of said first and second positioning means comprise a plurality of parallel first and second prongs, respectively.

4. The combination defined in claim 3 wherein said compartments are formed by rows of stakes parallel to said path, said first and second guide means comprising respective sets of vertical bars laterally offset from said rows of stakes, said prongs being substantially in line with said rows of stakes.

5. The combination defined in claim 3 wherein said first and second prongs are generally L-shaped, further comprising a set of center posts in said loading zone common to said first and second positioning means and disposed between the prongs thereof for supporting the erected slabs.

6. The combination defined in claim 3, further comprising feeder means horizontally reciprocable above said first and second conveyor means for transferring hot slabs from said first conveyor means to said first prongs and for transferring cooled slabs from said second prongs to said second conveyor means.

7. The combination defined in claim 6 wherein said first and second prongs are mounted rigid with one another on a plurality of bases interconnected by a common shaft and rotatable through about 180°.

8. The combination defined in claim 7 wherein said common bases are each provided with a third prong between respective first and second prongs.

9. The combination defined in claim 1 wherein said first and second conveyor means are sets of driven rollers.

10. The combination defined in claim 9 wherein said rollers are parallel to said path.

* * * * *